US005519420A

United States Patent [19]

Zorn et al.

[11] Patent Number: 5,519,420

[45] Date of Patent: May 21, 1996

[54] AIR SYSTEM TO PROTECT INK JET HEAD

[75] Inventors: Donald Zorn; Marek W. Czesnik, both of Kitchener; Brian Dyack, Waterloo; Rudolf Enter, Kitchener, all of Canada

[73] Assignee: NCR Corporation, Dayton, Ohio

[21] Appl. No.: 993,589

[22] Filed: Dec. 21, 1992

[51] Int. Cl.[6] ..... B41J 2/165

[52] U.S. Cl. ..... 347/25; 347/34; 55/337; 400/173

[58] Field of Search ..... 346/140 R; 347/101, 347/25, 22, 34; 406/173; 55/337, 429, 345

[56] References Cited

U.S. PATENT DOCUMENTS

| | | | |
|---|---|---|---|
| 3,854,399 | 12/1974 | Keur et al. | 347/34 |
| 4,361,845 | 11/1982 | Smith | 347/90 |
| 4,411,706 | 10/1983 | Wallace et al. | 134/37 |
| 4,591,869 | 5/1986 | Katerberg et al. | 347/21 |
| 4,861,178 | 8/1989 | Reed | 400/719 |
| 4,996,538 | 2/1991 | Brecy et al. | 346/74.3 |

FOREIGN PATENT DOCUMENTS

| | | | |
|---|---|---|---|
| 000237669 | 9/1987 | European Pat. Off. | 347/25 |
| 0371828 | 6/1990 | European Pat. Off. . | |
| 61-164838 | 7/1986 | Japan | 346/140 R |

*Primary Examiner*—Benjamin R. Fuller
*Assistant Examiner*—Craig A. Hallacher
*Attorney, Agent, or Firm*—Elmer Wargo

[57] ABSTRACT

A system for cleaning documents of dust particles as the documents are moved to a print station in a terminal where an ink jet printer is used to print on the documents. A vacuum manifold is positioned upstream of the print station to clean a document of dust as the document is moved towards the printer. A cyclone dust collector is used to collect the dust particles gathered by the vacuum manifold. An air curtain system provides a curtain of air between the print head of the printer and the face of the document to be printed upon to keep any dust particles left at the print station from coming into contact with the nozzles or jets of the printer.

6 Claims, 3 Drawing Sheets

AIR SYSTEM TO PROTECT INK JET HEAD

BACKGROUND OF THE INVENTION

1. Field of Invention

This invention relates to a system and method of protecting an ink jet print head when the print head is used to print on documents which may have dust particles thereon.

2. Background Information

When an ink jet printer is used to print on documents which carry dust, the printing which results is not as clear as it could be, and, because of the dust, the nozzles of the print head become clogged and require frequent cleaning.

In ink jet printing, as the document to be printed upon passes the print head, tiny droplets of ink "fly" through the air and land on the document. By controlling the sequence of nozzles which are activated, it is possible to form dot matrix characters on the passing document.

The diameters of the nozzles on the print head are smaller than the diameter of a human hair, and as such, they are susceptible to blockage by dust, such as paper dust particles from the passing documents. When a paper dust particle blocks a nozzle, the ink droplets from that nozzle are either deflected or blocked entirely. This results in poor print quality, with the affected characters having deflected or missing dots.

The offending dust particles can generally be removed by wiping the surface of the ink jet head with a "clean room quality" dust free cloth. Occasionally, however, it is necessary to pressurize the ink supply and force some ink through the nozzles in order to "purge" the dust particles from the nozzle. This operation is commonly referred to as a "reprime" operation. Both of these wiping and priming operations are nuisances, and they require the operator of the machine to stop it and to perform a number of maintenance operations.

SUMMARY OF THE INVENTION

An object of this invention is to provide a method and system for reducing the likelihood of nozzle blockage in an ink jet printer at a printing station which prints on documents carrying dust to the printing station.

Another object of this invention is to provide a low cost system which requires reduced maintenance time compared to prior art systems.

In the present system, a vacuum system is used to clean the documents prior to the documents arriving at the printing station. The present system also includes an "air curtain" at the printing station so as to deflect any dust particles away from the nozzles of the ink jet print head.

In a first aspect of this invention, there is provided a system for cleaning documents of dust particles as the documents are moved to a print station, comprising:

- a document track in which the documents are moved in a feeding direction therein;
- a vacuum manifold located adjacent to said document track upstream from said print station;
- a cyclone dust collector having an inlet port, an outlet port, a body portion, and a collection cup; and
- a conduit coupling said vacuum manifold with said inlet port to said cyclone dust collector.

In another aspect of this invention, there is provided a method of reducing the cleaning time required for cleaning the nozzles of an ink jet printer located at a print station in a terminal, comprising the steps of:

(a) cleaning a document to be printed upon of dust particles at a location upstream of said print station; and (b) providing an curtain of air between the nozzles of the ink jet printer and the document to be printed upon during printing on said document.

The above advantages, and others, will be more readily understood in connection with the following specification, claims, and drawing.

BRIEF DESCRIPTION OF THE DRAWING

FIG. 4 is an exploded view of a portion of the cyclone dust collector shown in FIG. 2.

FIG. 5 is a schematic diagram of an air curtain means for providing a curtain of air between the document and the ink jet printer shown in FIG. 1.

FIG. 6 is a side view, taken from the direction of arrow A of FIG. 1 to show additional details of the air curtain shown in FIG. 1.

FIG. 7 is an isometric view of the air curtain shown in FIG. 6, with the view taken from the general direction of the arrow B shown in FIG. 6.

FIG. 8 is an isometric view of the air curtain, with this view being taken from the direction of arrow C of FIG. 7.

FIG. 9 is a view similar to FIG. 8, showing in exploded view, another element included in the air curtain.

FIG. 10 is a general, cross-sectional view, taken along the line 10—10 of FIG. 6, to show the ink jet printer and the air curtain.

DETAILED DESCRIPTION OF THE PREFERRED EMBODIMENT

Figure 1:
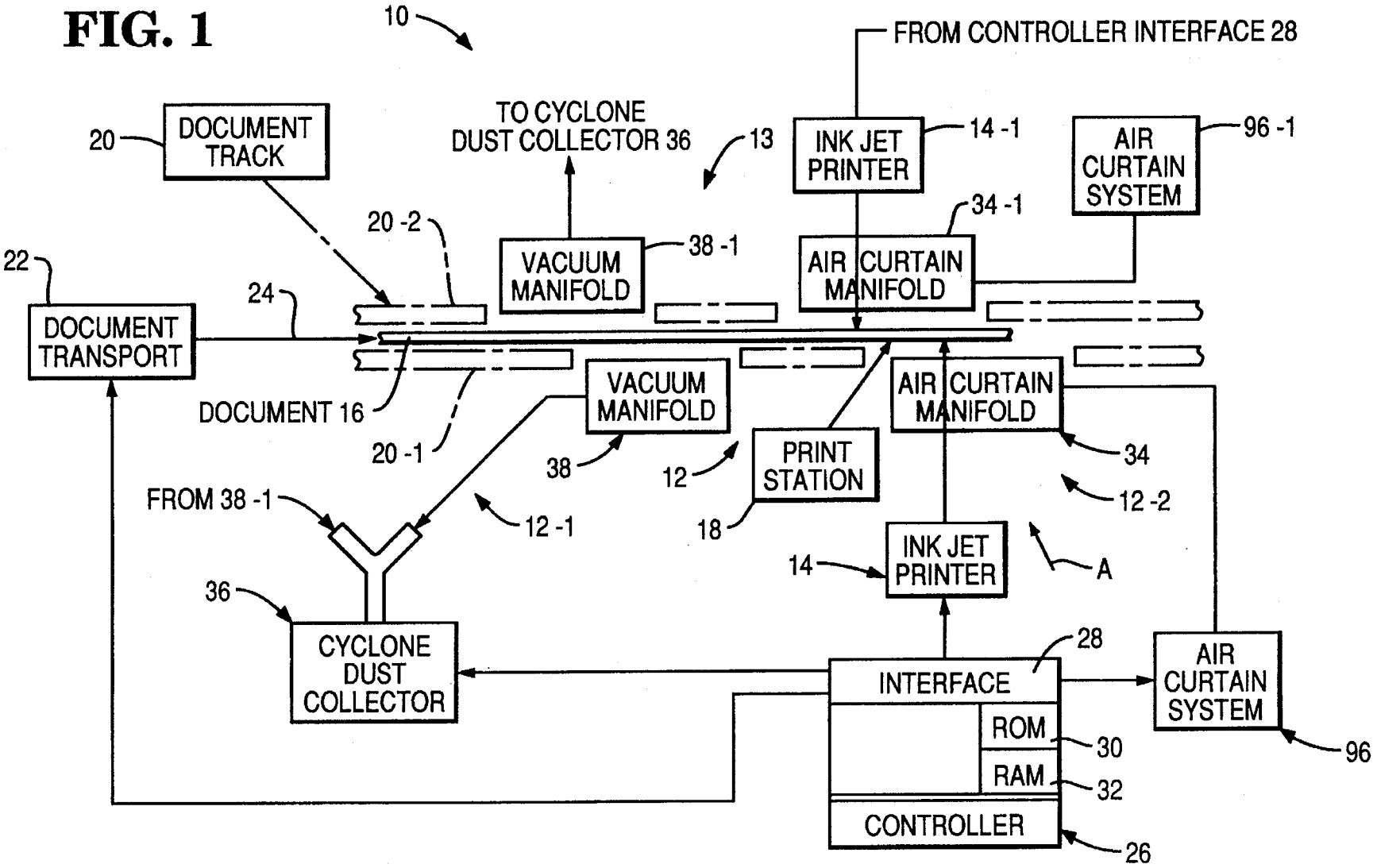
FIG. 1 is a schematic diagram, in plan view, of a business terminal, like an endorser, for example, in which the air system made according to this invention may be incorporated. The long top edge of a document is shown in a document track associated with the terminal.

FIG. 1 is a schematic diagram showing a terminal 10, like an encoder, for example, in which this invention may be incorporated. This invention relates to an air system 12 for protecting an ink jet head in an ink jet printer 14, shown only schematically in FIG. 1. The air system 12 includes a cleaning means 12-1 for cleaning dust particles from the front side of a document 16 and also includes an air curtain means 12-2 for directing a curtain of air between the document 16 to be printed upon and the ink jet printer 14 at a print station designated generally as 18. An air system 13, similar to air system 12, may be used for cleaning the rear side of the document 16.

The terminal 10 (FIG. 1) also includes a document track 20, having upstanding sides 20-1 and 20-2 which are shown in dashed outline to orient the reader. A document transport 22 is used to move the document 16 in a feeding direction in the direction of arrow 24 towards the print station 18, for example. The document transport 22 is coupled to a controller 26 via an interface 28, with the controller 26 conventionally controlling the movement of the document 16 in the terminal 10. Interface 28 represents a collection of conventional interfaces for coupling the controller 26 to the various elements in the terminal 10. The controller 26 has a ROM 30 and a RAM 32 in which software for controlling the operation of the terminal 10 may reside.

As stated in the Background Information, when documents are presented to a printer, like an ink jet printer, for example, the documents carry dust particles which tend to block the nozzles located in the ink jet head of the ink jet printer. When a dust particle blocks a nozzle, the ink droplets from that nozzle are either deflected or blocked entirely. This results in poor printing quality and requires cleaning. In one prior art system, the nozzles in the ink jet head had to be cleaned every 15 minutes.

A feature of the present invention is that the dust particles (which are mostly paper dust particles) are removed from the document 16 by the cleaning means 12-1. Another feature of this invention is that the air curtain means 12-2 functions to direct particles of dust which may remain on the document 16 away from the ink jet printer 14. It would seem, initially, that a curtain of air or air curtain 34 between the document 16 and the ink jet printer 14 would interfere with the ink droplets being directed at the document 16. However, when this air curtain 34 was tried, it proved to be very effective in preventing the nozzles of the ink jet printer from being blocked. The cleaning maintenance was reduced from being required every 15 minutes to being required once during eight hours of operation.

Another feature of the present invention is that the cleaning means 12-1 includes a cyclone dust collector 36 to collect the dust which is removed from the documents 16. Typically, cyclone dust collectors are used in saw mills and grain milling plants where the dust particles are quite large and there is adequate space for dust collectors. The cyclone dust collector 36 is compact and efficient; in fact it is so efficient that the air which is discharged therefrom can be discharged into the interior of the terminal 10 without concern for dust accumulating on the interior of the machine.

Figure 2:
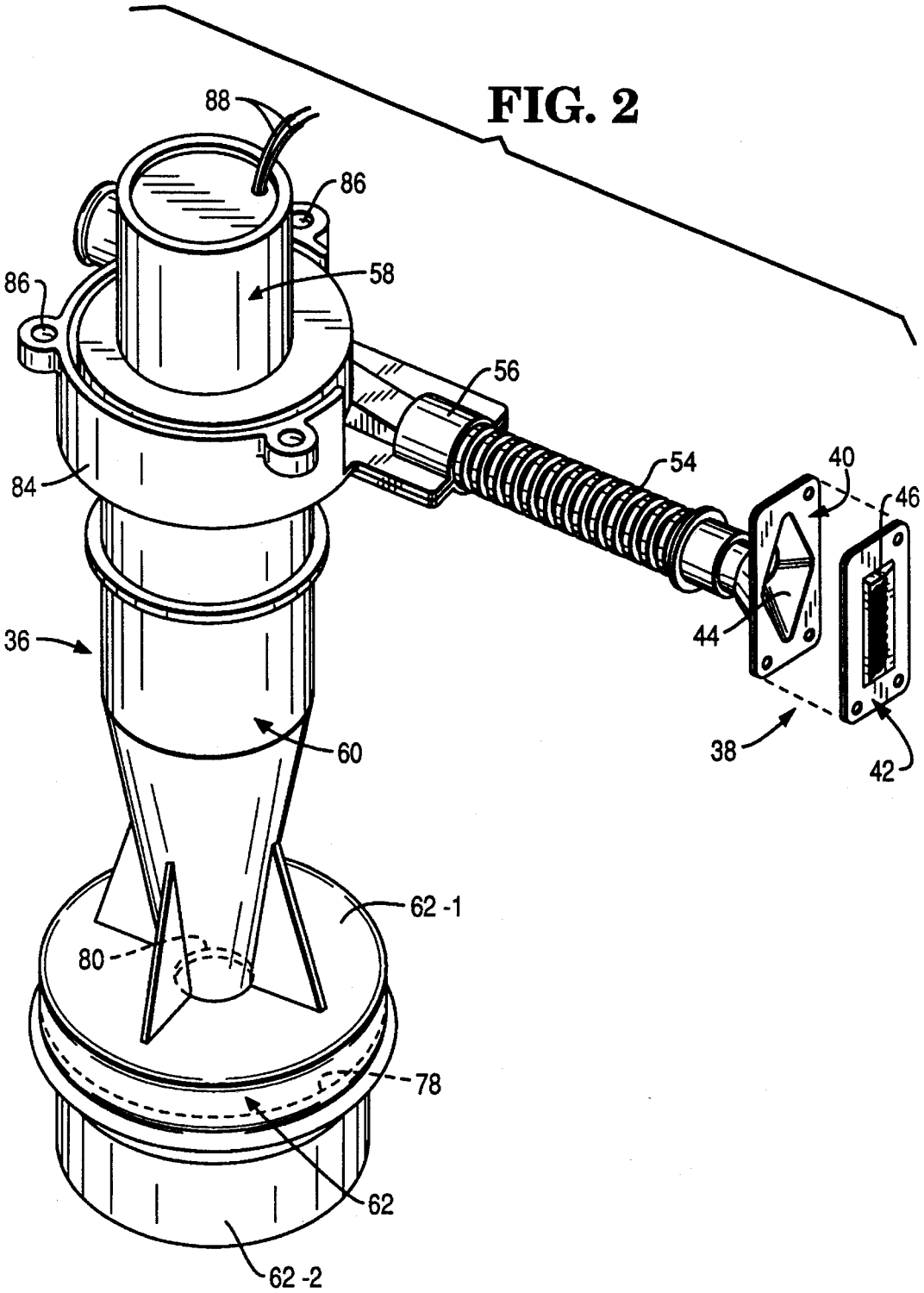
FIG. 2 is an isometric view of a cleaning means including a cyclone dust collector for cleaning documents before they arrive at a print station where an ink jet printer is located.
Figure 3:
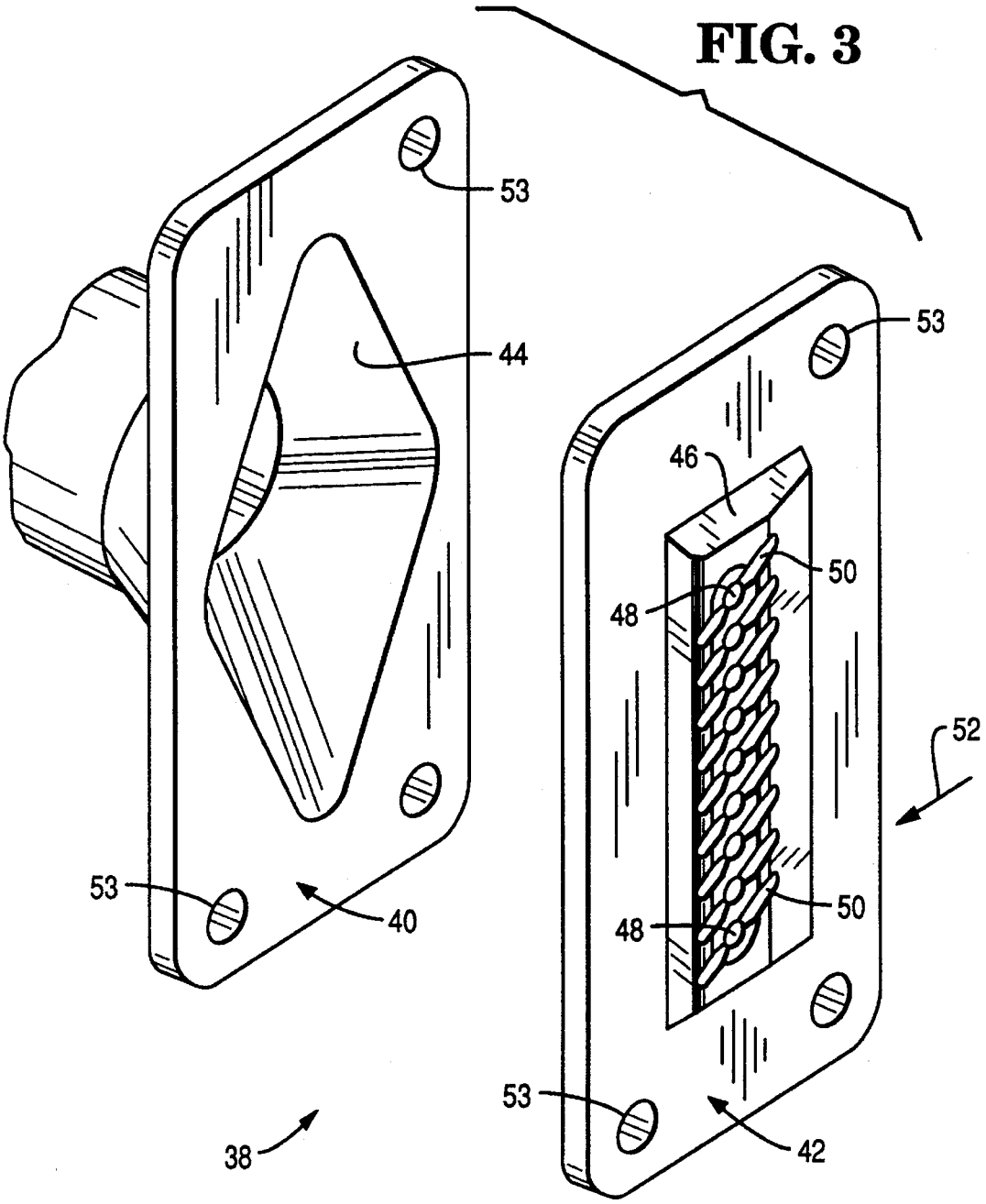
FIG. 3 is an enlarged view of a vacuum manifold, shown only schematically in FIG. 1.

The cleaning means 12-1 includes the cyclone dust collector 36 alluded to, and it also includes a vacuum manifold 38, shown schematically in FIG. 1 and also shown in detail in FIGS. 2 and 3. The vacuum manifold 38 is mounted upstream of the ink jet printer 14 so that the document 16 can be cleaned prior to reaching the print station 18. The vacuum manifold 38 includes a manifold 40 and an inlet plate 42. The vacuum manifold 38 is contoured, as shown at area 44, to distribute the vacuum across the height thereof, as shown in FIG. 2. The inlet plate 42 has a thickened area 46 thereon which protrudes through a recess in the document track 20 to enable the document 16 to brush thereagainst on its way to the print station 18. This thickened area 46 has a plurality of holes 48 therein to expose the document 16 to the vacuum from the cyclone dust collector 36. The inlet plate 42 also has a plurality of spaced parallel grooves 50 therein, with each of the grooves 50 communicating with one of the holes 48. These shallow grooves 50 in the surface of the inlet plate 42 insure that the document 16 does not seal off the supply of vacuum and that there is a continuous flow of air across the surface of the document 16. It is the air flow which sucks the paper dust, for example, from the surface of the document 16. The spaced parallel grooves 50 are positioned at an angle relative to the feeding direction (shown by arrow 52 in FIG. 3) of the document 16 so as to increase the area of coverage of the holes 48 and the grooves 50 on the document 16. Suitable mounting holes 53 in the manifold 40 and the inlet plate 42 are used to secure the vacuum manifold 38 to the side 20-2 of the document track 20.

The dusty air which is vacuumed from the surface of the document 16 by the vacuum manifold 38 is routed to the cyclone dust collector 36 by the flexible conduit 54 which is coupled to the vacuum manifold 38 and an inlet port on the cyclone dust collector 36, as shown best in FIG. 2. The details of the cyclone dust collector 36 are shown in FIGS. 2 and 7.

The operation and construction of the cyclone dust collector 36 are as follows. The basic parts of the cyclone dust collector 36 are a blower 58, a body 60, and a collection cup 62. The body 60 includes a spiralling compartment 63 (FIG. 4) which receives the dusty air from the vacuum manifold 38 and causes the dusty air to move tangentially, as shown by the arrow 64. As the air moves tangentially as described, the dust particles which exist in the air are moved downwardly and outwardly towards the outer portions of the cyclone body 60. At this point, the air moving down in the cyclone dust collector 36 (shown by arrows 66) is separated from the air moving up in cyclone dust collector 36 (shown by arrow 68) by a tube 70. The air moving up in the tube 70 is clean air which has the dust particles removed and collected in collection cup 62. The blower 58 has an inlet port 72 which is aligned with the tube 70 so that the blower can exhaust air from the cyclone dust collector 36 and discharge it to the atmosphere via a discharge port 74. A resilient seal 76, positioned between the blower 58 and the spiralling compartment 63 (FIG. 4), is used to provide a seal between these two elements.

As the dust particles descend downwardly and outwardly in the body 60 of the cyclone dust collector 36 (as viewed in FIG. 2), the dust particles settle in the collection cup 62. The collection cup 62 has a lid portion 62-1 and a detachable cup portion 62-2 to enable the cup portion 62-2 to be removed to enable the collection cup 62 to be emptied of the dust contained therein. A resilient seal 78, shown only diagrammatically in FIG. 2, is used to provide a seal between the lid portion 62-1 and the cup portion 62-2. The lid portion 62-1 has an opening 80 in the center thereof to enable the dust particles and dust laden air to enter the collection cup 62. When the air enters the collection cup 62, the air tends to lose its velocity due to the increased volume of the collection cup 62 itself, and the direction of the air travel becomes more random. The dust particles actually collect on the bottom of the collection cup 62 rather than on the sides thereof. The dust-free air is then drawn up through the center tube 70 by the blower 58. The blower 58 fits inside the walls 82 and 84 (FIG. 4) of the cyclone dust collector 36. An apertured plate 79 (shown only partially in FIG. 4) and fasteners 81 are used to secure the blower 58 to the cyclone dust collector 36 via threaded mounting holes 86. The blower 58 has connection wires 88 which couple it to the controller 26 to be controlled thereby.

The cyclone dust collector 36 offers several advantages over conventional filter separation of dust particles. First, filters slowly lose their efficiency as they become clogged with dust. In order to detect that a filter needs to be changed, one of the ways of performing this function is to use a detector which measures the pressure drop across the filter. This requires a pressure sensor and some sort of calibration scheme which are both costly and difficult to implement. Secondly, the cost of the filter itself and the environmental impact of the filter can be avoided when using the cyclone dust collector 36. In the embodiment described, cyclone dust collector 36, including the collection cup 62, is made of transparent plastic material to determine when the collection cup 62 needs to be emptied of the dust collected therein.

The air curtain means 12-2 alluded to earlier herein is shown in FIG. 5, and it includes the air curtain manifold 34, a regulator 88 which is coupled to the air curtain manifold 34 by a conduit 90, a blower 92, and a filter 94. The conduit 90, regulator 88, blower 92, and the filter 94 are part of an air curtain system 96, shown only diagrammatically in FIG. 1. The function of the air curtain means 12-2 is to provide a curtain of air between the ink jet printer 14 and the document 16 to be printed upon so as to direct dust particles away from the ink jet printer 14.

The air curtain manifold 34 is shown in FIGS. 6, 7, 8, and 9. The air curtain manifold 34 is positioned in a recess 98 in the side 20-1 of the document track 20, as shown in FIG. 6, and it is secured to the side 20-1 by suitable fasteners 99. There is a suitable elongated slot 100 in the side 20-1 of the document track 20 to enable the ink jet printer 14 to print on the document 16.

The construction of the air curtain manifold 34 is shown in FIGS. 7, 8, and 9. The air curtain manifold 34 has a first chamber 102 having an inlet connector 104 to which the flexible conduit 90 (FIG. 5) is connected to supply air under pressure thereto. The air from the first chamber 104 communicates with a distributor or a second chamber 106 which distributes the air along the length of the air curtain manifold 34, which length is indicated by double arrow 108, as shown in FIG. 9. A planar control member 110, which is generally "U"-shaped, is secured to one side of the air curtain manifold 34 by fasteners 112, as shown in FIG. 9. The control member 110 has an area 114 of reduced thickness to enable the flow of air (shown by arrows 116) from the second chamber 106 to flow downwardly over the face of the ink jet printer 14. In doing so, the flow of air moves any dust particles away from the ink jet printer 14. The area 114 of reduced thickness, relative to the control member 110, provides an air curtain which is about 0.018 inch thick in the embodiment described.

The ink jet printer 14 is shown in more detail in FIG. 10. This printer 14 may be mounted, conventionally, on a pivot member 120 to enable the printer 14 to be pivoted along the arc 122 away from the side 20-1 of the document track 20 to enable the printer 14 to be cleaned. A conventional latch 124 is used to detachably secure the ink jet printer 14 in the position shown in FIG. 10. The ink jet printer 14 has individual orifices or jets 126 which are mounted in a support member 128 (FIG. 10). The support member 128 is mounted at an angle of about 19.5 degrees relative to the bottom of the document track 20, as shown by double arrow 130 in FIG. 6. In the embodiment described, the height of the characters printed by the ink jet printer 14 is ⅛ inch. By tilting the orifices or jets 126 at the angle of 19.5 degrees, the printing which can be effected by the printer 14 is about ⅝ inch high and includes four lines of printing.

As previously stated, the side 20-1 of the document track 20 has a slot 100 therein to enable the ink from the jets 126 to reach the document 16. The slot 100 is longer than the length between the outermost jets 126; this dimension was arrived at after some experimentation. When the slot 100 was just as long as the distance between the outermost jets 126, there were currents, like "eddy" currents, which were created at the extreme ends of the slot 100, especially the downstream end, and these currents caused scattered dots from the ink jet printer 14. It was found that a distance of about ¼ inch between the outermost jets 126 and the associated ends of the slot 100 minimized this disturbance.

The regulator 88 shown in FIG. 5 is set to provide a pressure of one inch of water at the regulator itself and to provide a pressure of one half inch of water at the second chamber 106 (FIG. 8) of the air curtain manifold 34 in the embodiment described. With these pressures, the air curtain coming from the air curtain manifold 34 was effective in blowing any dust particles entering the slot 100, downwardly, and away from jets 126 of the ink jet printer 14 and not affect the path of the droplets of ink impacting against the document 16 during the printing process. To arrive at the pressure indicated, the air pressure was increased to the point at which it began to affect the location of the droplets of ink, and thereafter, the pressure was lessened until a maximum air flow was obtained without affecting the displacement of characters printed by the ink jet printer 14.

There are several important factors to consider with regard to the ink jet printer 14:

1. The member 128 (FIG. 10) in which the jets 126 are located, should be kept as close to the document 16 as possible. The member 128 fits against the back side of the planar control surface or area 114(FIG. 10) in the side 20-1 of the document track 20.
2. From experimentation, the frontal plane of the member 128 should be located within one and one half millimeters from the document 16 itself.
3. The ink jet printer 14 is programmable, so that processing numbers can be printed on the individual checks 16. For example, a check 16 may be check #1 out of 200 checks in a batch of checks.
4. While the ink jet printer 14 is shown in a position to print on the front of the document 16, printing may also be effected on the back of the document. In North America, endorsement of checks is effected on the rear of a check, while in many European countries, the endorsement of checks is effected on the front of the check.
5. While the air flow shown by the air curtain form the air curtain manifold 34 is in a downward direction, as shown in FIG. 6, the air flow could be directed to a side or upwardly if space considerations warranted it.

The air system 12, which has been described, can be repeated for printing or endorsing data on the rear of the document 16, as viewed in FIG. 1. In this regard, the air system 13 is identical to the air system 12 already described. Consequently, those elements which are the same as the corresponding elements in the air system 12 will be given the same basic number; however, those in air system 13 will be given a dash (-) number. For example, the vacuum manifold in air system 13 is designated as 38-1. Correspondingly, the air system 13 also includes the ink jet printer 14-1, the air curtain manifold 34-1 and the air curtain system 96-1, with these elements having the same operation as their corresponding elements in air system 12.

What is claimed is:

1. A system for cleaning documents of dust particles as the documents are moved to a print station located in an interior of a terminal, comprising:

a document track in which the documents are moved in a feeding direction therein towards the print station;

a vacuum manifold located adjacent said document track upstream from the print station;

a cyclone dust collector having an inlet port, an outlet port, a body portion, and a collection cup; and a conduit coupling said vacuum manifold with said inlet port to said cyclone dust collector;

said cyclone dust collector having a spiraling compartment coupled to said inlet port for moving dust particles outwardly and downwardly relative to said collection cup and also having a tube centrally located relative to said collection cup and coupled to said outlet port;

said collection cup including (i) a lid portion connected to said body portion and (ii) a cup portion having a dust accumulating chamber and detachably connected to said lid portion and for, when detached from said lid portion, enabling dust particles contained in the dust accumulating chamber of said cup portion to be emptied.

2. A system as claimed in claim 1 wherein said cup portion includes a bottom wall portion and a side wall portion connected to and extending away from said bottom wall portion, said wall portions cooperating to define (i) the dust accumulating chamber of said cup portion and (ii) an opening through which dust particles can pass from said body portion into the dust accumulating chamber when said cup portion is connected to said lid portion.

3. A system as claimed in claim 1 wherein said vacuum manifold includes a vacuum inlet plate facing an area of the document to be cleaned, said vacuum inlet plate having a plurality of substantially parallel grooves therein and openings in the parallel grooves to permit air and dust particles to pass between said vacuum inlet plate and the area of the document to be cleaned; and the plurality of grooves being positioned at an angle relative to the feeding direction.

4. A system as claimed in claim 1 further comprising:

an ink jet printer including a print head located at the print station to enable ink droplets from said ink jet printer to impact against the document located at the print station; and an air curtain system including an air manifold positioned at the print station to provide a protective curtain of air between said print head and the document to keep dust particles from coming in contact with said print head, the ink droplets passing through the protective curtain of air prior to impacting against the document located at the print station.

5. A system for cleaning documents of dust particles as the documents are moved to a print station located in an interior of a terminal, comprising:

a document track in which the documents are moved in a feeding direction therein towards the print station;

a vacuum manifold located adjacent said document track upstream from the print station, said vacuum manifold including a vacuum inlet plate facing an area of the document to be cleaned, said vacuum inlet plate having a plurality of substantially parallel grooves therein and openings in the parallel grooves to permit air and dust particles to pass between said vacuum inlet plate and the area of the document to be cleaned, the plurality of grooves being positioned at an angle relative to the feeding direction;

a cyclone dust collector having an inlet port, an outlet port, a body portion, and a collection cup; and a conduit coupling said vacuum manifold with said inlet port to said cyclone dust collector;

said cyclone dust collector having a spiraling compartment coupled to said inlet port for moving dust particles outwardly and downwardly relative to said collection cup and also having a tube centrally located relative to said collection cup and coupled to said outlet port.

6. A system for cleaning documents of dust particles as the documents are moved to a print station located in an interior of a terminal, comprising:

a document track in which the documents are moved in a feeding direction therein towards the print station;

a vacuum manifold located adjacent said document track upstream from the print station;

a cyclone dust collector having an inlet port, an outlet port, a body portion, and a removable collection cup;

a conduit coupling said vacuum manifold with said inlet port to said cyclone dust collector;

said cyclone dust collector being so efficient as to enable air which is discharged from said outlet port to be discharged into the interior of the terminal without concern for dust accumulating on the interior of the terminal;

said cyclone dust collector having a spiraling compartment coupled to said inlet port for moving dust particles outwardly and downwardly relative to said collection cup and also having a tube centrally located in said collection cup and coupled to said outlet port;

an ink jet printer located at the print station to enable ink droplets from said ink jet printer to impact against a document located at the print station; and an air curtain system having an air manifold positioned at the print station to provide a protective curtain of air between a print head and the document to keep dust particles from coming in contact with said ink jet printer, the ink droplets passing through the protective curtain of air prior to impacting against the document located at the print station;

said air curtain system including an air regulator for maintaining the air flow through said air manifold strong enough to provide the protective curtain of air yet gentle enough so that ink droplets from said ink jet printer do not get significantly deflected from their paths;

said air regulator having a pressure therein and said air manifold having a pressure therein with said pressure of said air manifold being about one half of the pressure of said air regulator.

* * * * *